United States Patent [19]

Yang

[11] Patent Number: 4,692,096

[45] Date of Patent: Sep. 8, 1987

[54] CEILING FAN

[76] Inventor: Tai-Her Yang, 5-1 Taipin St., Si-Hu Town, Dzan-Hwa, Taiwan

[21] Appl. No.: 884,594

[22] Filed: Jul. 11, 1986

[51] Int. Cl.[4] ..... F04D 29/64

[52] U.S. Cl. ..... 416/170 R; 416/5

[58] Field of Search ..... 416/170 R, 170 C, 5; 417/354

[56] References Cited

U.S. PATENT DOCUMENTS

| | | | |
|---|---|---|---|
| 560,569 | 5/1896 | Brinser | 416/170 C |
| 585,250 | 6/1897 | Bennett | 416/5 |
| 1,935,314 | 11/1933 | Finch et al. | 416/5 X |
| 2,119,398 | 5/1938 | Morse | 416/5 |
| 4,073,598 | 2/1978 | Mizutani et al. | 416/170 C X |
| 4,342,073 | 7/1982 | Ranten | 416/5 X |
| 4,396,352 | 8/1983 | Pearce | 416/5 X |
| 4,402,649 | 9/1983 | Laurel | 416/5 |
| 4,518,314 | 5/1985 | Schultz | 416/5 |
| 4,538,973 | 9/1983 | Angott et al. | 416/170 C X |
| 4,640,668 | 2/1987 | Yang | 416/5 X |

FOREIGN PATENT DOCUMENTS

| | | | |
|---|---|---|---|
| 385772 | 1/1933 | United Kingdom | 416/5 |

*Primary Examiner*—Everette A. Powell, Jr.
*Attorney, Agent, or Firm*—Leonard Bloom

[57] ABSTRACT

A ceiling fan is presented having a centrally disposed stationary rotor and a rotating stator annularly positioned about the rotor. The rotor has a longitudinal void formed therethrough to receive an on/off switch and housing therefore. This configuration provides a ceiling fan which can be fabricated at lower cost, utilizes minimal space and is easier to install than conventional ceiling fans.

8 Claims, 3 Drawing Figures

CEILING FAN

FIELD OF THE INVENTION

The present invention relates to ceiling fans and, in particular to ceiling fans having an "inside-out" motor housed in a two-piece motor housing unit.

BACKGROUND OF THE INVENTION

Traditional ceiling fans of which I am aware employ a motor having a centrally positioned rotating rotor. This motor is housed in a motor housing and drives the fan blades via a drive shaft which emerges from the housing and extends downwardly therefrom. Finally an electrical on/off switch is positioned in its associated housing unit (a switch box) which also extends downwardly from the motor housing.

Unfortunately, the above design requires that the switch box be formed of two parts, which can be difficult to fabricate, requires additional parts and increases costs. Also, the electrical switches of the fans of the prior art described above are electrically connected to their power source by several electrical wires which are disposed through the rotating central portion of the motor. This arrangement makes assembly difficult and can result in damage to these wires. Finally, such an arrangement, as is described above, unnecessarily occupies large volumes of space, which limits their use.

Thus, it will be appreciated that there remains a need to alleviate the deficiencies and disadvantages of the prior art by providing a motor driven ceiling fan which is simplified, compact, has a one-piece switch housing (switch box) and wherein the electricall wires leading to the switch housing (switch box) are not disposed through a rotating portion of the fan.

SUMMARY OF THE INVENTION

Accordingly, it is the primary object of the present invention to alleviate the disadvantages and deficiencies of the prior art by providing a ceiling fan operated by an external alternating current (a.c.) power source. This fan is provided with a motor housing. A motor is housed substantially within the motor housing. This motor has a rotor being centrally positioned stator which is stationary during the operation thereof. This stator has a longitudinal void formed therethrough. The motor further has a rotor annularly positioned about the stator. The rotor is rotationally moveable during the operation of the fan. Means is provided for suitably securing the motor housing to the rotor for rotational movement therewith. A plurality of fan blades are equidistantly positioned about the motor housing. Means is provided for suitably securing the fan blades to the motor housing for rotational movement therewith, the rotor being fixedly attached to the housing. A hollow suspension conduit has an upper portion suitably secured to the ceiling for suspension therefrom and a lower portion suitably secured to the stator. The suspension conduit is disposed through the motor housing, being journaled in bearings. In this manner, rotational movement of the motor housing about the conduit is facilitated. A switch housing is positioned substantially directly below the void of the stator. Means is provided for securing the switch housing to the stator. An electrical on/off switch means is provided for controlling the operation of the motor. The switch means is substantially housed within the switch housing extending therethrough, thereby providing manual access to said switch for the operation thereof. Electrical cables provide electrical communication between the external a.c. power source and the on/off switch means. The electrical cables are disposed through the suspension conduit and the void.

DESCRIPTION OF THE PREFERRED EMBODIMENTS

Figure 1A:
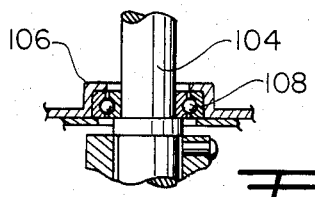
FIG. 1A is an enlarged portion of FIG. 1.
Figure 1:
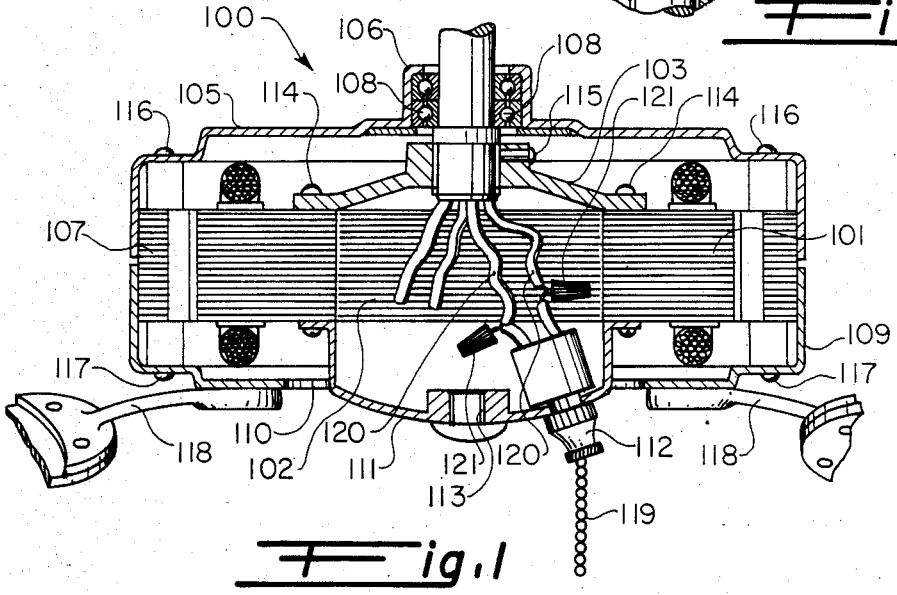
FIG. 1 is a longitudinal cross-sectional view of the driven ceiling fan of the present invention.

Referring now to the drawings, in FIG. 1 there is illustrated in cross-section the motor ceiling fan of the present invention. The fan 100 is provided with an "inside-out" motor having a centrally disposed stator 101 which is stationary during operation of the fan. The stator 101 is substantially circular in shape, having a centrally disposed void 102 formed longitudinally therethrough, thereby giving it a substantially donut-shaped appearance.

Secured to the upper portion of stator 101 is a supporting bracket 103. The bracket 103 is substantially inverted cup-shaped in appearance and has an aperture centrally formed therethrough. The rim of the bracket 103 is suitably secured to the upper portion of the stator 101 by bolts 114. Disposed through the aperture of the bracket 103 is a hollow suspension conduit 104 having an upper portion which is suitably secured to the ceiling (not shown) for suspension therefrom and a lower portion. The lower portion of suspension conduit 104 is suitably secured in the aperture of the bracket 103 by a horizontal mounting pin 115.

The motor housing is comprised of an upper rotating cover 105 and a lower rotating cover 109. Upon cover 105 is substantially inverted cup-shaped in appearance and has a base and a downwardly extending skirt portion. The base of the upper cover 105 is provided having a centrally positioned hub (bearing housing) 106 formed therethrough. The suspension conduit 104 is disposed through the hub 106 and is positioned therethrough, being journaled in bearings 108. The upper rotating cover 105 is suitably secured to a rotor 107, which is annularly positioned about the rotor 101. Upper cover 105 is suitably secured to the rotor 107 by bolts 116 or any other suitable means. It should be noted that while, as seen in FIG. 1, an upper and a lower set of ball bearings 108 are illustrated, if desired, merely one set of ball bearings, as seen in FIG. 1A, may be provided instead.

A lower rotating cover 109 is substantially circular in shape being cup-like in appearance having a base and an upwardly extending side wall. The base is provided having a centrally positioned circular aperture 110 formed therethrough. The lower cover 109 is secured to the rotor 107 by bolts 117 or any other suitable means. The fan blades 118 are suitably secured to the lower cover 109 for rotational movement therewith.

Figure 2:
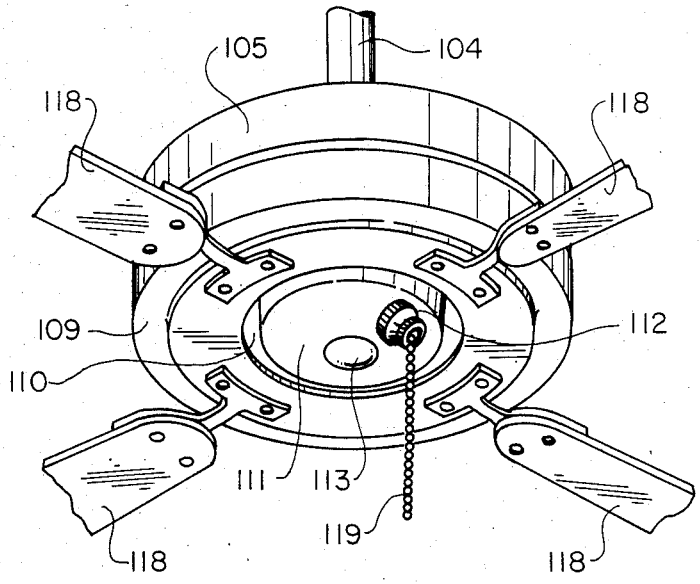
FIG. 2 is an elevated view of the motor driven ceiling fan of the present invention.

Secured to the underside of the stator 101 is a stationary switch housing (switch box) 111. The switch housing 111 is substantially cup-shaped in appearance being formed having a base, an upwardly extending annular side wall and an outwardly extending annular rim on the upper portion of the side wall. The switch housing 111 is suitably secured in place by a plurality of bolts 117 which extend through the annular rim. The base of the switch housing 111 is formed having an upwardly extending hub 113 centrally positioned therein. If desired a bolt 113 can be provided for support of a hanging lamp, etc. As perhaps best seen in FIG. 2, being positioned thusly, the switch housing 111 emerges from the bottom of the motor housing through the aperture 110 of the lower cover 109 so that the base of the switch housing 111 is substantially parallel to the base of the lower cover 109.

On/off switch 112 is carried by the switch housing 111 extending therethrough. Switch 112 has an actuator, illustrated as an external pull chain 119, which can be pulled in order to activate/deactivate the motor as desired. Switch 112 is electrically connected to an external a.c. power source (not shown) via electrical cables or wires 120. The wires 120 extend from the external a.c. power source through and the hollow suspension conduit 104 where it emerges within the motor housing. The wires 120 then extend through the central opening 102 of the stator 101, where the wires are secured to the wires of the switch 112 by means of wire nuts 121.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A ceiling fan to be energized from an external alternating current power source, the ceiling fan consisting essentially of:

a motor housing;

an a.c. motor housed within said motor housing and having a stator which is stationary during operation of the fan, said stator having a longitudinal void formed therethrough, said motor further having a rotor annularly positioned about the stator, said rotor being rotationally moveable during the operation of the fan;

means for securing the motor housing to the rotor for rotational movement therewith;

a plurality of fan blades fixed to the motor motor housing, said blades being equidistantly positioned about the motor housing for rotational movement with said motor housing and said rotor;

a hollow suspension conduit having an upper portion to be secured to a ceiling for suspension therefrom and a lower portion extending into said motor housing and secured to the stator within said motor housing, said suspension conduit being disposed through the motor housing and being journaled in bearings, wherein rotational movement of the motor housing about the conduit is facilitated;

a single piece switch housing and support positioned substantially directly below the void of the stator and including an inner surface and an aperture;

means within the motor housing for securing the switch housing and support to the stator;

an electrical on/off switch means positioned adjacent to the aperture on the inner surface of the switch housing and support for controlling the operation of the motor, said switch means having an actuator thereof extending through said aperture in the switch housing and support thereby providing manual access to said switch means via the actuator for the operation thereof; and electrical cables for providing electrical communication between the external power source and the on/off switch means, said electrical cables being disposed through the suspension conduit and the void;

wherein said motor housing consists of an upper cover having a base provided with an aperture centrally formed therein receiving the suspension conduit therethrough and a bearing housing annularly positioned about said aperture in said upper cover, said upper cover further having a downwardly extending skirt portion fixed to periphery of said rotor and being contiguous with said base and a lower cover having a base provided with an aperture centrally formed therein in substantial alignment with the void, said aperture in said lower cover receiving the switch housing therethrough, said lower cover further having an upwardly extending side wall fixed to the periphery of said rotor and being contiguous with said base of said lower cover; and wherein the switch housing consists of a base, an upwardly extending side wall contiguous with said base of said switch housing, and an outwardly extending rim annularly positioned about and contiguous with said side wall of said switch housing, said rim being fixed to said stator.

2. The ceiling fan of claim 1, wherein the stator is substantially donut-shaped.

3. The ceiling fan of claim 2, wherein the actuator includes a pull chain for activation and deactivation of the switch means.

4. The ceiling fan of claim 1, wherein the actuator includes a pull chain for activation and deactivation of the switch means.

5. A ceiling fan to be energized from an external alternating current power source, the ceiling fan comprising:

a motor housing;

an a.c. motor housed within said motor housing and having a stator which is stationary during operation of the fans, said stator having a longitudinal void formed therethrough, said motor further having a rotor annularly positioned about the stator, said rotor being rotationally moveable during the operation of the fan;

means for securing the motor housing to the rotor for rotational movement therewith;

a plurality of fan blades fixed to the motor housing, said blades being equidistantly positioned about the motor housing for rotational movement with said motor housing and said rotor;

a hollow suspension conduit having an upper portion to be secured to a ceiling for suspension therefrom and a lower portion extending into said motor housing and secured to the stator within said motor housing, said suspension conduit being disposed through the motor housing and being journaled in bearings, wherein rotational movement of the motor housing about the conduit is facilitated;

a single piece switch housing and support positioned substantially directly below the void of the stator and including an inner surface and an aperture;

means within said motor housing for securing the switch housing and support to the stator;

an electrical on/off switch means positioned adjacent to the aperture on the inner surface of the switch housing and support for controlling the operation of the motor, said switch means having an actuator thereof extending through said aperture in the switch housing and support thereby providing manual access to said switch means via the actuator for the operation thereof; and electrical cables for providing electrical communication between the external power source and the on/off switch means, said electrical cables being disposed through the suspension conduit and the void; and wherein said motor housing consists essentially of an upper cover having a base provided with an aperture centrally formed therein receiving the suspension conduit therethrough and a bearing housing annularly positioned about said aperture, in said upper cover, said upper cover further having a downwardly extending skirt portion fixed to periphery of said rotor and being contiguous with said base and a lower cover having a base provided with an aperture centrally formed therein in substantial alignment with the void, said aperture in said lower cover receiving the switch housing therethrough, said lower cover further having an upwardly extending side wall fixed to the periphery of said rotor and being contiguous with said base of said lower cover; and wherein the switch housing and support is of unitary construction and consists of a base portion and a peripherial portion contiguous with said base portion of said switch housing and support, said peripherial portion being fixed to said stator.

6. The ceiling fan of claim 5, wherein the stator is substantially donut-shaped.

7. The ceiling fan of claim 6, wherein the actuator includes a pull chain for activation and deactivation of the switch means.

8. The ceiling fan of claim 5, wherein the actuator includes a pull chain for activation and deactivation of the switch means.

* * * * *